US006767683B2

(12) United States Patent
Nakamura et al.

(10) Patent No.: US 6,767,683 B2
(45) Date of Patent: Jul. 27, 2004

(54) IMAGE FORMING TONER, 2-COMPONENT DEVELOPER, IMAGE FORMING METHOD AND METHOD FOR MANUFACTURING IMAGE FORMING TONER

(75) Inventors: Yasushige Nakamura, Kawasaki (JP); Yasuyuki Furuse, Kawasaki (JP); Seijirou Ishimaru, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/084,327

(22) Filed: Feb. 28, 2002

(65) Prior Publication Data

US 2002/0146631 A1 Oct. 10, 2002

Related U.S. Application Data

(62) Division of application No. 09/617,748, filed on Jul. 17, 2000, now abandoned.

(30) Foreign Application Priority Data

Oct. 20, 1999 (JP) ..... 11-298585

(51) Int. Cl.[7] ..... G03G 13/20

(52) U.S. Cl. ..... 430/124; 430/108.4; 430/109.4; 339/336

(58) Field of Search ..... 430/124, 109.4, 430/109.1, 111.4, 108.4, 108.8; 399/336

(56) References Cited

U.S. PATENT DOCUMENTS 4,229,512 A * 10/1980 Lenhard et al. ..... 430/106
4,788,123 A * 11/1988 Berkes et al. ..... 430/124
5,618,648 A * 4/1997 Horikoshi et al. ..... 430/109.4
5,691,096 A * 11/1997 Baird et al. ..... 430/109
5,840,459 A * 11/1998 Ohno et al. ..... 430/109
5,985,502 A * 11/1999 Ayaki et al. ..... 430/109
6,175,715 B1 * 1/2001 Hirao et al. ..... 399/384
6,191,843 B1 * 2/2001 Takiguchi ..... 399/51
6,194,115 B1 * 2/2001 Nagase et al. ..... 430/109.4

FOREIGN PATENT DOCUMENTS

EP 0901046 A1 * 3/1999
JP 05107805 A * 4/1993 ..... G03G/9/087
JP 6-27722 2/1994
JP 7-244400 9/1995
JP 10-198068 7/1998

OTHER PUBLICATIONS

Diamond, Arthur S. (editor) Handbook of Imaging Materials. New York: Marcel–Dekker, Inc. (1991). pp. 201–202.*
Diamond, Arthur S. (editor). Handbook of Imaging Materials. New York: Marcel–Dekker, Inc. pp. 160–162. (1991).*
Schaffert, R. M. Electrophotography. New York: John Wiley & Sons. pp. 55–57. (1975).*

* cited by examiner

*Primary Examiner*—Christopher Rodee
(74) *Attorney, Agent, or Firm*—Westerman, Hattori, Daniels & Adrian, LLP

(57) ABSTRACT

This invention relates to image formation toner, 2-component developer, image formation method and method for manufacturing image formation toner, for preventing clogging of the filter. Toner is used in which the ratio of the component measured by GPC to have a molecular weight between 500 to 1000 is 10 parts by weight or less with respect to 100 parts by weight of the entire toner. Since the case of clogging of the HEPA filter is the 500 to 1000 molecular weight component, clogging of the filter is prevented by reducing this component.

9 Claims, 2 Drawing Sheets

IMAGE FORMING TONER, 2-COMPONENT DEVELOPER, IMAGE FORMING METHOD AND METHOD FOR MANUFACTURING IMAGE FORMING TONER

This application is a division of prior application Ser. No. 09/617,748 filed Jul. 17, 2000 now abandoned.

BACKGROUND OF THE INVENTION

1. Field of the Invention

This invention relates to an image forming toner, 2-component developer, image forming method and method for manufacturing image forming toner for electronic photography devices, and more particular to the image forming toner, 2-component developer, image forming method and method for manufacturing image forming toner that is suitable for application in an image forming apparatus with a high temperature fixing.

2. Related Arts

In recent years, image forming apparatus that uses electronic photography technique are used as computer output devices. In this kind of image forming apparatus, high speed processing is desired. Therefore, image forming toner that is suitable for high-speed printing is also desired.

A typical electronic photography method for image forming apparatus comprises the following steps: The photosensitive body is charged and then exposed by light image, thereby a latent image is formed on the photosensitive body. Developer is supplied to the photosensitive body and the latent image is developed, and then the toner image is transferred to the medium. Then the toner is fixed to the medium.

A heat rolling method or oven method that heats the toner directly by a roller or the like, and a flash fixing method that performs fixation by light irradiation or extreme infrared radiation are widely used as the method for fixing the toner.

In the heat rolling method, the toner is fixed by bringing a high-temperature roller in contact with the toner and heating and applying pressure it directly. Therefore, it is possible to make an inexpensive fixation mechanism. On the other hand, it has disadvantages in that the paper has a tendency to roll easily after fixation, the paper may become dirty due to offset when the fixation roller becomes dirty from the toner, high-speed printing becomes difficult and fixing toner to seals and post cards is difficult when the paper rolls.

In the flash fixation method there is no direct contact so it has advantages in that the paper is not rolled after fixation, there is no offset, high-speed printing is possible, and it is easy to fix toner to seals and postcards. Therefore, flash fixation is used in high-speed printers and copiers.

In high-speed fixation methods such as flash fixation, a large quantity of energy is applied to the sheet instantaneously, and the temperature of the most top surface of the printing toner reaches 300° C. or more. Therefore, sublimation of the binder resin component of the toner occurs. Gas and odors are produced by this sublimation.

The toner binder for flash fixation must instantly raise the temperature of the toner to make it soft and melt, so toner with different properties than the toner for the heat-roller fixation method is desired. In other words, a material with a high decomposition temperature is used. A toner whose main component is a polyester resin is used as the binder for this flash fixation toner. Also, in order to reduce the gas and odor produced by the aforementioned sublimation, it is proposed that the mean molecular weight of the polyester resin should be between 10,000 and 50,000 (for example as disclosed in Japanese unexamined published patent No. H5-107805).

Ultra-high-speed printing is desired in this kind of image formation apparatus. For example, the capability of printing 100 sheets or more per minute is desired. When forming images at ultra high speed, the fixation speed is also increased, and the sublimation matter of the toner binder increases. In order to prevent that this sublimate is directly discharged to the air, so a dust collection system using highly efficient smoke filters is installed in the printer.

However, with conventional toner, the smoke filter quickly becomes clogged with the sublimate. Therefore, in a high-speed printer, there is the problem that the replacement period of the filter is shortened.

SUMMARY OF THE INVENTION

The objective of this invention is to provide image forming toner, 2-component developer, an image forming method and method for manufacturing image forming toner for image forming devices for preventing early clogging of a filter even when performing high-speed image formation.

Another objective of this invention is to provide image forming toner, 2-component developer, an image forming method and method for manufacturing image forming toner for image forming devices for reducing odors during fixation.

A further objective of this invention is to provide image forming toner, 2-component developer, an image forming method and method for manufacturing image forming toner for image forming devices for lengthening the life of the filter and improving the quality of fixation.

Yet a further objective of this invention is to provide image forming toner, 2-component developer, an image forming method and method for manufacturing image forming toner for image forming devices for lengthening the life of the filter and making stable developing possible.

A toner for image formation of this invention comprises at least a binder resin and colorant and where the ratio of the 500 to 1000 molecular weight components of the toner, measured by gel permeation chromatography, is 10 parts by weight or less with respect to 100 parts by weight of the entire toner.

The inventors analyzed the components clogging the filter in order to gain a better understanding of the clogging of the filter due to sublimation of the toner binder. To do this, the structure and mass of the clogging components were analyzed by a nuclear magnetic harmonic spectrogram. As a result, the following was found:

First, the sublimate component in flash fixation is a monomer component mainly made up of a bisphenol-A-alkylene oxide additive with molecular weight of 500 or less, or dimer or trimer comprising a bisphenol-A-alkylene oxide additive with molecular weight between 500 to 1000 and phthalic acid or trimellitic acid.

Second, components with a molecular weight of 500 to 1000 are found largely on the top layer of the filter while components with a molecular weight of 500 or less are found largely on the bottom layer of the filter. Moreover, since the monomer component with a molecular weight of 500 has a small molecular weight, it reaches the bottom layer of the filter, whereas the sublimate component with a molecular weight of 500 to 1000 becomes hardened on the surface layer of the filter and becomes the major cause of clogging of the filter.

Therefore, in order to reduce clogging of the filter and to lengthen its life, it is important to reduce the total weight of the 500 to 1000 molecular weight component in the toner. As a result of diligent investigation and research, it was found that when the ratio of the toner components having a molecular weight of 500 to 1000, is 10 parts by weight or less with respect to 100 parts by weight of the entire toner, then it is possible to lengthen the life of the filter. It is even more desirable for the ratio to be 5 parts by weight or less. It is desirable that the lower limit of the components having a molecular weight of 500 to 1000 be as near to zero as possible.

In another feature of the invention, the ratio of the toner component having molecular weight of 500 or less that is measured by gel permeation chromatography, is less than 4 parts by weight with respect to the 100 parts by weight of the entire toner.

From the results of the analysis it was found that since the monomer component with molecular weight of 500 or less is a small molecular weight, it passes through the filter and becomes the cause of odor. This monomer component can be recovered somewhat by the activated charcoal of the filter, however, this component must also be reduced from the toner.

Therefore, in this invention, the odor is reduced by making the ratio of the toner component with molecular weight of 500 or less 4 parts by weight or less with respect to the 100 parts by weight of the entire toner.

In another feature of the invention, the binder resin comprises at least a polyester resin consisted of the bisphenol-A-alkylene oxide additive expressed by the chemical formula 1 given below.

[Chemical Formula 1]

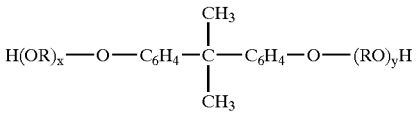

(In the formula, R is an ethylene or propylene base, and x and y are both integers equal to 1 or more.)

Polyester resin is used for the binder resin so it is possible to prevent decomposition of the binder even when the fixation temperature is high as in the case of flash fixation.

In another feature of the invention, x and y in the formula for the bisphenol-A-alkylene oxide additive are 1, and R is an ethylene-based compound making up 60 mole % or more of the polyester alcohol component.

With x and y in the formula for the bisphenol-A-alkylene oxide additive equal to 1, and R as a ethylene-based compound, reactivity is high and it is possible to reduced the monomer, and dimer or trimer components remaining in the polyester. By doing this, it is possible to prevent clogging of the filter, as well as to reduce odors.

In another feature of the invention, 0.01 to 10 parts by weight of the compound given by the chemical formula 2 below is added.

[Chemical Formula 2]

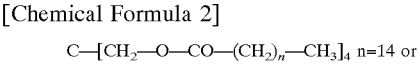

This makes it possible to improve flash fixation as well as makes it possible to prevent printing defects called void. Furthermore, it is preferred when the added weight is 0.5 to 5 parts by weight.

In another feature of the invention, a polypropylene compound with an mean molecular weight of 10,000 or more is added. By adding the polypropylene compound, it is possible to improve the pulverization characteristics of the toner. Furthermore, since the mean molecular weight of the polypropylene compound is greater than 10,000, it is possible to prevent any effects from it on clogging of the filter.

In another feature of the invention, the toner is toner used in flash fixation. Since the toner is used in flash fixation, it is possible to reduce clogging of the filter and odors due to sublimation of the binder during flash fixation.

The 2-component developer of this invention, comprises toner and a carrier, in which the ratio of the component of the toner determined by gel permeation chromatography to have molecular weight of 500 to 1000 is less than 10 parts by weight with respect to the 100 parts by weight of the entire toner, and a carrier that has an average particle diameter of 30 to 100 $\mu$m.

This makes it possible to prevent clogging of the filter, as well as makes it possible to supply a 2-component developer with a long life.

The image forming method of this invention comprises: a step of forming a toner image on a medium by using a toner in which the ratio of the component of the toner determined by gel permeation chromatography to have molecular weight of 500 to 1000 is less than 10 parts by weight with respect to the 100 parts by weight of the entire toner; and a step of performing flash fixation of the toner on the medium.

This makes it possible to prevent clogging of the filter even when performing flash fixation.

The method of manufacturing toner for image formation of this invention comprises: a step of creating a polyester binder; a step of washing the created polyester binder with alcohol; and a step of mixing the polyester binder, that has been washed with alcohol, with a colorant to create the toner.

Alcohol does not melt the high-molecular-weight polyester, however the monomer and dimer are dissolved in alcohol. Therefore, by washing the polyester binder with alcohol, it is possible to greatly reduce the monomer or dimer that causes clogging of the filter and odors.

Other features and advantages of the present invention will become readily apparent from the following description taken in conjunction with the accompanying drawings.

DETAILED DESCRIPTION OF THE PREFERRED EMBODIMENTS

Figure 1:
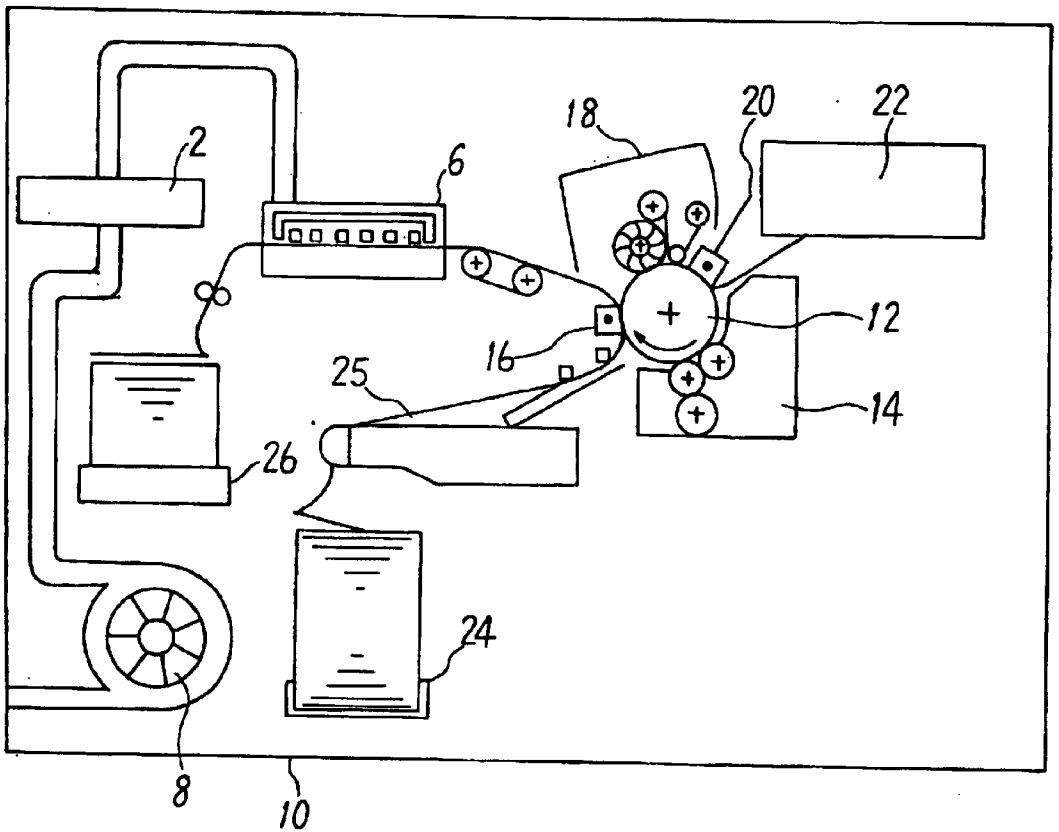
FIG. 1 is a configuration drawing of a printer that uses the toner of this invention.
Figure 2:
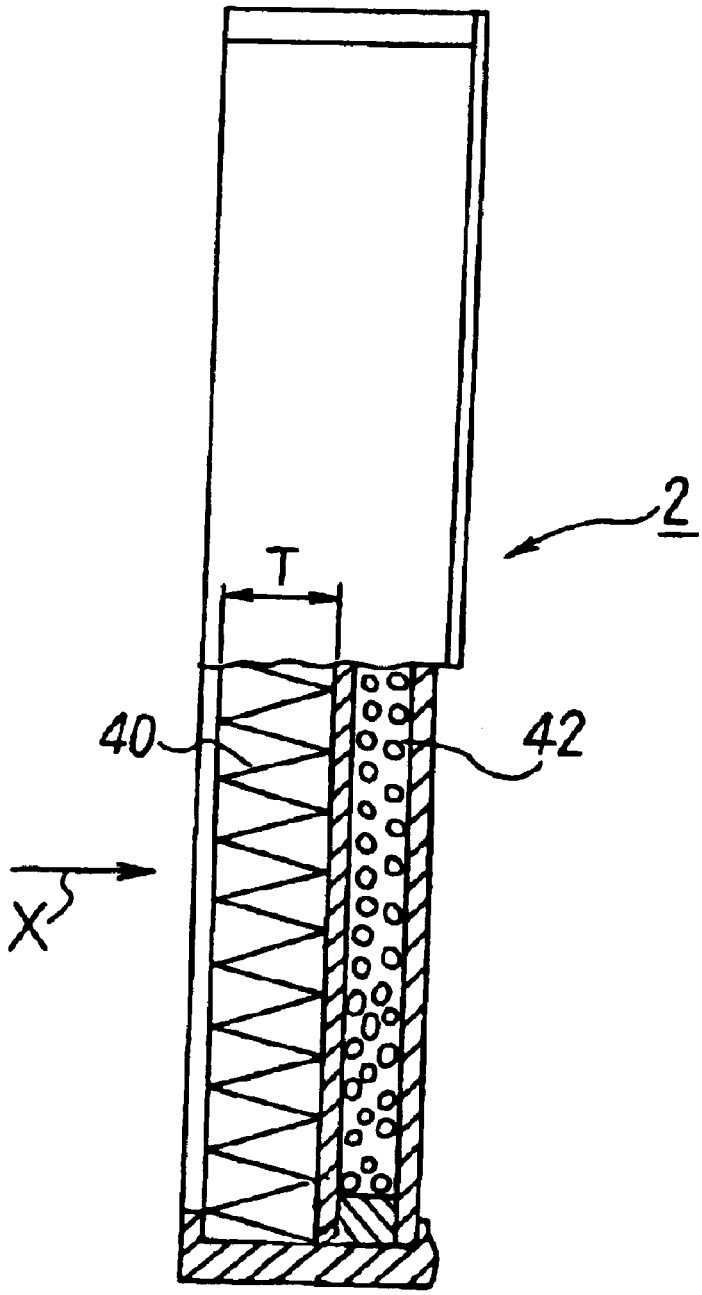
FIG. 2 is a cross-sectional view of the filter in FIG. 1.

FIG. 1 is a configuration diagram of a printer of one embodiment of the this invention, and FIG. 2 is a cross-sectional view of that filter.

As shown in FIG. 1, the printer 10 comprises an electrophotographic mechanism. A photo-sensitive drum 12 is charged by a charger 20, and then is exposed by a laser exposure device 22. By doing this, a latent image is formed on the photo-sensitive drum 12. A developing device 14 supplies 2-component developer to the photo-sensitive drum 12, and develops the latent image to a toner image. A transfer device 16 transfers the toner image on the photo-sensitive drum 12 to a sheet 25. A cleaning mechanism 18 discharges the light-sensitive drum 12 after transfer, and removes any remained toner.

The sheet 25 is continuous-type paper and is loaded in a hopper 24. The sheet 25 in the hopper 24 is guided to the transfer position, and then passes through a flash fixing device 6 and is stored in a stacker 26. In the flash fixing device 6, the flash light energy is 0.5 to 3.0 J/cm$^2$, and the light emission time is 500 to 3000 $\mu$s. When used toner with suitable fixation characteristics when the light-emission energy is high and the light-emission time is long, the paper could burn easily. Therefore, the aforementioned light-emission energy and light-emission time is suitable.

This printer 10 is capable of high-speed printing, for example it is capable of printing 100 sheets or more per minute. Therefore, there is a lot of toner sublimate due to flash fixation. In order to remove this sublimate, there is a filter 2 and an exhaust fan 8.

As shown in FIG. 2, the filter 2 comprises a HEPA filter 40 and activated carbon 42. The HEPA filter 40 is capable of absorbing 0.3 $\mu$m sized particles with an efficiency of 99.97% or greater. The HEPA filter 40 is constructed from a multi-layered glass filter into a pleated shape. The activated carbon 42 is for removing odors. The filter 40 can be single layered, however efficiency is better when it is multi-layered. Also, the filter material can be a cellulose fiber, however, for maximum absorption efficiency, glass fiber is suitable.

An inorganic photo-sensitive material such as amorphous silicone or selenium, or an organic photo-sensitive material such as polysilane or phthalocyanine can be used for the photo-sensitive body. From the aspect of long life, an amorphous silicone photo-sensitive body is desirable.

Next, the developer of this invention is explained.

Toner

In the toner, the ratio of the component, that is measured by gel permeation chromatography (called GPC below) to have a molecular weight of 500 to 1000, is 10 parts by weight or less with respect to the 100 parts by weight of the entire toner. Preferably, this ratio is 5 parts by weight or less. Since the component having a low molecular weight of 500 to 1000 causes clogging of the filter, it is necessary to reduce this component as much as possible. With the component at 10 parts by weight or less, it is possible to practically prevent a drop in the life of the filter. Moreover, a lower limit of zero is desirable, however, it is difficult to manufacture toner with this component being 0 parts by weight.

In addition, making the component measured by GPC to have a molecular weight of less than 500 to be 4 parts by weight or less with respect to the 100 parts by weight of the entire toner, is effective in reducing odor. Here, when the polyester resin of the toner binder comprises a bisphenol-A-alkylene oxide additive having the chemical formula given below, unreacted bisphenol-A-alkylene oxide additive is possible by making this component less than 4 parts by weight. Similarly, it is difficult to manufacture toner with this component being 0 parts by weight.

[Chemical Formula 3]

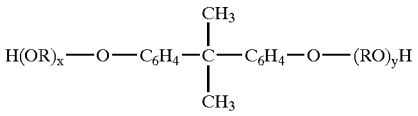

(In the formula, R is an ethylene or propylene base, and x and y are both integers equal to 1 or more.)

The ratio of this molecular weight component of the toner is measured by GPC. This measurement method will be described. First, the weight (W1) of the toner is measured. Next, the toner is dissolved in tetrahydrofuran, and filtered through a 0.2 $\mu$m thick membrane filter. The filter used for filtering is then dried, and the weight (W2) is measured. A GPC device is used to measure the molecular weight distribution of the toner component dissolved in the tetrahydrofuran by differential refractive index detector, and from the calibration curve, the ratios (X) of all of the molecular weight components are found. From this result, the weight ratio (P) of each molecular weight component of the toner with respect to 100 parts by weight of the entire toner is calculated by the following equation.

$$P=[(W1-W2)/W1]\times X$$

The toner contains a polyester binder and a colorant. A well known binder can be used for this polyester binder (for example U.S. Pat. No. 4,804,622 as disclosed in Japanese Unexamined Published patent S62-291668). For this polyester binder, it is preferable that at least a bisphenol-A-ethylene or propylene oxide additive is used as the alcohol component, at least terephthalic acid is used as the acid component, and trimellitic acid is used as the cross linking agent. The glass transfer temperature should be 60° C. or greater, and for the toner, it is preferable that it is 58° C. or greater. This is because when the glass temperature is below 58° C., there is a possibility that the toner will harden during operation.

It is possible to use general-purpose material as the binder to be used in the toner together with polyester. For example, it is possible to combine styrene acrylic resin, epoxy resin, polyether polyol resin or the like with single or a plurality of polyester resin.

Terephtalic acid, isophtalic acid, orthophtalic acid, or the hydrides of these can be used as the acid component of the polyester. The prefered is terephtalic acid or isophtalic acid. It is possible to combine one or two or more of these.

It is possible to use other acids in combination with the above compounds as long as there is no problem with odor during flash fixation. For example, maleic acid, fumaric acid, citraconic acid, itaconic acid, glutaconic acid, cyclohexane carboxylic acid, succinic acid, adipic acid, sebacic acid, azelaic acid, or malonic acid can be used. Furthermore, alkyl or alkenyl succinic acids such as n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, and isododecyl succinic acid, or the hydrides of these acids, low-grade alkyl ester, and other trihydric or greater carboxylic acid component: can be used. Moreover, in order to perform cross linking with the polyester, trihydric or greater carboxylic acid component can similarly be used in combination as the acid component. It is possible to use 1-, 2-, 4-benzene tricarboxylic acid, 1-, 3-, 5-benzene tricarboxylic acid, other polycarboxylic acids, and the hydrides of these as the trihydric or greater carboxylic acid component.

It is desired that when the bisphenol-A-alkylene oxide additive given by the chemical formula (1) above is used as the polyester alcohol component that it be 80 mole % or more of the alcohol component. It would even be better to be 90 mole % or 95 mole %.

Polyoxypropylene (2,2)-2,2-bis (4-hydroxyphenyl) propane, polyoxypropylene (3,3)-2,2-bis (4-hydroxyphenyl) propane, polyoxyethylene (2,0)-2,2-bis (4-hydroxyphenyl) propane, polyoxyethylene (2,2)-2,2-bis (4-hydroxyphenyl) propane, polyoxypropylene (2,0)-polyoxyethylene (2,0)-2,2-bis (4-hydroxyphenyl) propane, polyoxypropylene (6)-2,2-bis (4-hydroxyphenyl) propane and the like can be used as the bisphenol A alkylene oxide additive.

Particularly, polyoxypropylene (2,2)-2,2-bis (4-hydroxyphenyl) propane (called BPA-PO), polyoxyethelene (2,0)-2,2-bis (4-hydroxyphenyl) propane (called BPA-EO (2,2)) is desirable. Of these, it is possible to combine one or two or more.

When used for flash fixation, it is best when the compound given by the aforementioned chemical formula is a bisphenol A alkylene oxide additive where x and y are 1 and R is an ethylene base, and where the compound is 60 mole % or greater of the polyester alcohol compound. It is even better when it is 80 mole % or greater.

This is because a compound in which x and y are 1 and R is an ethylene base is the most reactive of the aforementioned compounds, and makes it possible to reduce the monomer, dimer and trimer remaining in the polyester. This makes it possible to reduce the remain monomer, dimer, and trimer that is the cause of clogging of the filter and odors.

Moreover, when necessary, it is possible to use other alcohol components in combination with the aforementioned compounds. For example, it is possible to add diols such as ethylene glycol, diethylene glycol, triethylene glycol, 1,2-propylene glycol, 1,3-propylene glycol, 1,4-butane diol, neopentyl glycol, 1,4-butenediol, 1,5-pentanediol, or 1,-6 hexane diol, bisphenol A, hydrogenated bisphenol A or other dihydric alcohols.

It is possible to use sorbitol, 1,2,3,6-hexanetetrole, 1,4-solbitane, pentaerythritol, dipentaerythtol, tripentaerythol, 1,2,4-butanetriol, 1,2,5-pentanetriol, glycerol, 2-methylpropane triol, 2-methyl-1,2,4-butane triol, trimethylolethane, trimethylolpropane, and other triatomic or greater alcohols.

During reaction, it is possible to use a reaction accelerating catalyst such as an esterfication catalyst. For example, it is possible to use zinc oxide, first tin oxide, di-butyl tin oxide, or di-n-butyltindilaurate. The amount of these reaction accelerating catalysts can be increased as a method of reducing the monomer, dimer or trimer remaining in the polyester.

The created polyester is washed with alcohol. High-molecular-weight polyester does not dissolve in alcohol such as ethanol, methanol, or isopropyl alcohol, however, monomer and dimers do dissolve. Therefore, by washing the polyester with alcohol, it is possible to greatly reduce the monomer or dimer remaining in the polyester.

It is possible to use aniline blue (C.I. No. 50405), chalco oil blue (C.I. No. azoic blue 3), chrome yellow (C.I. No. 14090), ultra-marine blue (C.I. No. 77103), DuPont oil red (C.I. No. 26105), quinoline yellow (C.I. No. 47005), methylene blue chloride (C.I. No. 52015), phthalophenone blue (C.I. No. 74160), malachite green oxylate (C.I. No. 42000), lamp black (C.I. No. 77266), rose bengal (C.I. No. 45435), ECR-181 (Pg. No. 122) or a combination of these as toner colorants.

The amount of colorant used is normally 0.1 to 20 parts by weight with respect to 100 parts by weight of the entire toner, and particularly 0.5 to 10 parts by weight is desirable.

Furthermore, by adding a compound having the chemical formula given below to the toner, it is possible to improve flash fixation and to prevent printing defects called void.

$$C—[CH_2—O—CO—(CH_2)_n—CH_3]_4 \quad n=14 \text{ or more}$$

The amount of compound that should be added is 0.01 to 10 parts by weight with respect to the 100 parts by weight of the entire toner, and it is preferred to 0.5 to 5 parts by weight.

Flash fixation is suitable as the fixing method for a device that uses this toner, however, heat-roll fixation is also possible. It is all the more effective in flash fixation where there is a large amount of sublimate.

The toner can be magnetic or non-magnetic. Also, 2-component developing that employs a carrier, or 1-component developing are suitable as the developing method. Moreover, when necessary, it is possible to add a compound such as polyethylene or polypropylene in order to improve the pulverization condition of the toner. In order to prevent clogging of the filter, it is necessary to use a material that has no component having molecular weigh of 1000 or less, and whose mean molecular weight is 10,000 or greater. For the example of polypropylene, it is possible to used NP105 (product name) manufactured by Mitsui Chemical Co. The polypropylene should be added within a range of 0.1 to 5 weight % with respect to 100 parts by weight of the toner. Adding 0.1 weight % or more is effective in improving flash fixation and decreasing void. However, when more than 5 weight % is added, the fluidity of the toner becomes poor and can cause poor printing.

Furthermore, it is good to mix very fine inorganic particles in the toner as an agent to improve fluidity. The diameter of these inorganic particles should be in the range of 5 nm to 2000 nm, and best when in the range of 5 nm to 500 nm. Also, it is desirable that the specific surface area according to BET be 20 to 500 $m^2/g$.

The ratio that the particles should be mixed in the toner should be in the range of 0.01 to 5 parts by weight, and best when in the range of 0.01 to 2.0 parts by weight. It is possible, for example, to use fine silica powder, alumina, titanium oxide, barium titanate, magnesium titanate, calcium titanate, strontium titanate, zinc oxide, silica sand, clay, mica, wallastonite, diatom earth, chromium oxide, cerium oxide, red oxide, antimony trioxide, magnesium oxide, zirconium oxide, barium sulfate, barium carbonate, calcium carbonate, silicon carbide, or silicon nitride for this fine inorganic powder. However, fine silica powder is especially good.

Carrier

When this toner is used in a 2-component developer, the average diameter of the particles of the carrier core material should be within the range of 30 to 100 $\mu$m, and a diameter of 60 to 90 $\mu$m is especially desirable. When the average particle diameter is 20 $\mu$m or less, the amount of fine powder in the distribution of carrier particles increases, and the magnetization per particle decreases. Therefore, scattering of the carrier occurs. Moreover, when the average diameter of the carrier particles is greater than 100 $\mu$m the specific surface area decreases and scattering of the toner occurs. In full-color printing where there are many black-out areas, reproducibility of the black-out areas becomes poor, and it is not desirable.

It is best to use a resin-coated ferrite or iron powder for the carrier. The core material of the carrier should include at least manganese, and it is preferable when the magnetization at 10 kOe is 75 to 100 emu/g.

In order to increase the life of the carrier, the coating resin material should include at least epoxy transforming silicon, acyrlic transforming silicon, styrene transforming silicon, or straight silicon.

Solvents that can be used for forming the resin-coating layer on the carrier are toluene, xylene, methyl ethyl ketone, methyl isobutyl ketone.

The amount of resin coating in the resin-coated carrier should be within the range of 0.1 to 5.0 parts by weight with respect to the total weight of the resin-coated carrier, and better when it is within the range 0.15 to 2.0 parts by weight, and yet even better when it is within the range 0.8 to 1.5 parts by weight. When the amount of resin coating is less than 0.1 parts by weight, it is not possible to form coating uniformly on the surface of the carrier in the range of the surface coefficient (1.2 to 2.1) of the carrier core material used in this invention. On the other hand, when the amount of resin coating exceeds 5.0 parts by weight, the coating layer is too thick, and granulation occurs among carrier particles making it impossible to obtain uniform carrier particles.

The method of forming a resin-coating layer on the carrier core material is comprises, dissolving the coating resin in a solvent, then evenly applying the resin solvent to the carrier core material by dipping, spraying or brushing. It is then dried and the solvent is removed before baking.

It is possible to use either an external heating method or an internal heating method for the baking device. For example, baking can be performed by a stationary or moving electric oven, rotary-type electric oven, burner oven or microwave oven. The baking temperature should be 180 to 300° C., with the optimum temperature being 220 to 280° C. When the temperature is below 180° C., the coating is not sufficiently hardened, and when the temperature is higher than 300° C., then part of the silicon-type resin melts and the surface layer of the resin becomes rough making it impossible to obtain a uniform coating.

EXAMPLE (1) Polyester Resin

As shown in Table 1, eight kind of samples of polyester resin were made: three comparison samples (polyester resin No. 1, 2 and 8) and five embodiment samples (polyester resin No. 3 to 7).

TABLE 1

| | Raw | Comparison sample | | Actual sample | | | | | Comparison sample |
|---|---|---|---|---|---|---|---|---|---|
| | material monomer | Polyester No. 1 | Polyester No. 2 | Polyester No. 3 | Polyester No. 4 | Polyester No. 5 | Polyester No. 6 | Polyester No. 7 | Polyester No. 8 |
| Acid component (moles) | Terephthalic acid | 4.6 | 4.6 | 4.6 | 4.6 | 4.6 | 4.6 | 4.6 | 4.6 |
| | Isophthalic acid | 4.6 | 4.6 | 4.6 | 4.6 | 4.6 | 4.6 | 4.6 | 4.6 |
| | | 0.01 | 0.01 | 0.01 | 0.01 | 0.01 | 0.01 | 0.01 | 0.01 |
| Alcohol component (moles) | BPA–PO | 5 | 5 | 5 | 3.5 | 5 | 5 | 5 | 5 |
| | BPA–EO (2.2) | 5 | 5 | 5 | 6.5 | 5 | 5 | 5 | 5 |
| | Ethlene glycol | — | — | — | — | — | — | — | — |
| Catalyst (g) | Dibutyltindi-laurate | 5 | 5 | 5 | 5 | 50 | 5 | 5 | 5 |
| Temperature | ° C. × Time | 200° C. × 3 hours +240° C. × 3 hours | 200° C. × 15 hours +240° C. × 15 hours | 200° C. × 30 hours +240° C. × 30 hours | 200° C. × 1 hour +240° C. × 1 hour | 200° C. × 3 hours +240° C. × 3 hours | 200° C. × 3 hours +240° C. × 3 hours | 200° C. × 3 hours +240° C. × 3 hours | 200° C. × 3 hours +240° C. × 3 hours |
| Ethanol wash | — | None | None | None | None | None | 1 time | 2 time | 2 time |
| Add after BPA-PO | Parts by weight | — | — | — | — | — | — | — | 10 |

Polyester Resin No. 1 (Comparison Sample 1)

5.0 moles of polyoxypropylene (2,2)-2,2-bis (4-hydroxyphenyl) propane (BPA-PO), 5.0 moles of polyoxyethylene (2,2)-2,2-bis (4-hydroxyphenyl) propane (BPA-EO (2,2)), 4.6 moles of terephthalic acid, 4.6 moles of isophthalic acid, 0.01 moles of trimellitic acid anhydride and 5.0 grams of dibutyl-tin-oxide were placed in four glass flasks. A thermometer, stainless-steel mixing rod, downflow-type condenser, and nitrogen inlet tube are attached to the flasks. The mixture were allowed to react in a mantle heater and under nitrogen gas flow at 220° C. for 3 hours, at 240° C. for 3 hours and further at the same temperature at reduced pressure of 60 mmHg for 2 hours. From this, polyester resin No. 1 (comparison sample 1) was obtained.

Polyester Resin No. 2 (Comparison Sample 2)

Having the same composition as polyester resin No. 1, the reaction time was increased. In other words, the mixture were allowed to react in a mantle heater and under nitrogen gas flow at 220° C. for 15 hours, at 240° C. for 15 hours and further at the same temperature at reduced pressure of 60 mmHg for 2 hours. From this, polyester resin No. 2 (comparison sample 2) was obtained.

Polyester Resin No. 3 (Embodiment Sample 1)

Having the same composition as polyester resin No. 1, the reaction time was further increased. In other words, the mixture were allowed to react in a mantle heater and under nitrogen gas flow at 220° C. for 30 hours, at 240° C. for 30 hours and further at the same temperature at reduced pressure of 60 mmHg for 2 hours. From this, polyester resin No. 3 (embodiment sample 1) was obtained.

Polyester Resin No. 4 (Embodiment Sample 2)

Of the composition of polyester resin No. 1, BPA-PO is made to be 3.5 moles, and BPA-EO (2, 2) was made to be 6.5 moles. In other words, the amount of the highly reactive BPA-EO (2, 2) was increased. Also, the mixture were allowed to react in a mantle heater and under nitrogen gas flow at 220° C. for 1 hour, at 240° C. for 1 hour and further at the same temperature at reduced pressure of 60 mmHg for 2 hours. From this, polyester resin No. 4 (embodiment sample 2) was obtained.

Polyester Resin No. 5 (Embodiment Sample 3)

Of the composition of polyester resin No. 1, the dibutyltindilaurate catalyst is increased to 50 grams. In other words, the catalyst was increased in order to advance the reaction. The reaction was carried out under the same reaction conditions as for polyester resin No. 1. From this, polyester resin No. 5 (embodiment sample 3) was obtained.

Polyester Resin No. 6 (Embodiment Sample 4)

The polyester resin having the composition of polyester resin No. 1 and having undergone reaction under the reaction conditions for polyester resin No. 1 was washed one time with ethanol to obtain polyester resin No. 6 (embodiment sample 4).

Polyester Resin No. 7 (Embodiment Sample 5)

The polyester resin having the composition of polyester resin No. 1 and having undergone reaction under the reaction conditions for polyester resin No. 1 was washed two times with ethanol to obtain polyester resin No. 7 (embodiment sample 5).

Polyester Resin No. 8 (Comparison Sample 3)

Ten parts by weight of BPA-PO was added to polyester resin No. 7 (embodiment sample 5), that was obtained by washing two times with ethanol a polyester resin having the same composition of polyester resin No. 1 and had undergone reaction under the reaction conditions for polyester resin No. 1, to obtain polyester resin No. 8 (comparison sample 3).

(2) Toner

Toner samples 1 thru 8 were made using the aforementioned polyester resins No. 1 thru No. 8.

Toner 1 (Comparison Sample)

The toner components are 86 parts by weight of polyester resin No. 1, 10 parts by weight of carbon (product name Printex 35 manufactured by Mitsubishi Chemical Co.), 2 parts by weight of high-molecular-weight polypropylene (molecular weight: 10,000, product name: NP105 manufactured by Mitsui Chemical Co.), 1 part by weight of the compound of chemical formula (1) ($C—[CH_2—O—CO—(CH_2)_{20}—CH_3]_4$) (product name: WEP-5, manufactured by NOF corporation), and 1 part by weight of an electric charge controlling agent (product name: N-13 manufactured by ORIENT CHEMICAL INDUSTRIES. LTD). These components were put into a ORIENT CHEMICAL INDUSTRIES. LTD mixer and premixed, after which, the mixture was kneaded by an extolder. Next, it was ground to rough powder by a hammer mill, and then ground to fine power by a jet mill. Furthermore, it was separated by an air-flow separator, to obtain fine black particles having an volume average particle diameter of 8.5 μm. Next, 0.5 parts by weight of fine hydrohobic silica particles (product name: HV K2150, manufactured by Client Japan) was added and processed in a Clariant Japan K.K. mixer to obtain toner 1.

Toner 2 (Comparison Sample)

Polyester resin No. 1 in toner 1 is changed to polyester resin No. 2, and toner 2 is obtained by using identical weight ratios, composition, and conditions.

Toner 3 (Embodiment Sample)

Polyester resin No. 1 in toner 1 is changed to polyester resin No. 3, and toner 3 is obtained by using identical weight ratios, composition, and conditions.

Toner 4 (Embodiment Sample)

Polyester resin No. 1 in toner 1 is changed to polyester resin No. 4, and toner 4 is obtain by using identical weight ratios, composition, and conditions.

Toner 5 (Embodiment Sample)

Polyester resin No. 1 in toner 1 is changed to polyester resin No. 5, and toner 5 is obtained by using identical weight ratios, composition, and conditions.

Toner 6 (Embodiment Sample)

Polyester resin No. 1 in toner 1 is changed to polyester resin No. 6, and toner 6 is obtained by using identical weight ratios, composition, and conditions.

Toner 7 (Embodiment Sample)

Polyester resin No. 1 in toner 1 is changed to polyester resin No. 7, and toner 7 is obtained by using identical weight ratios, composition, and conditions.

Toner 8 (Embodiment Sample)

Polyester resin No. 1 in toner 1 is changed to polyester resin No. 8, and toner 8 is obtained by using identical weight ratios, composition, and conditions.

Toner 9 (Embodiment Sample)

The colorant of toner 3 is changed to magenta (product name: ECR 181, and toner 9 is obtained by using identical weight ratios, composition, and conditions.

Toner 10 (Comparison Sample)

In the composition of toner 3, the compound of chemical formula (2), ($C—[CH_2—O—CO—(CH_2)_{20}—CH_3]_4$) (product name: WEP-5, manufactured by MITSUICHEMICALS. INC), is taken to be "0", and toner 10 is obtained under the same conditions.

Toner 11 (Actual Sample)

In the composition of toner 3, in the place of the compound of chemical formula (2), ($C—[CH_2—O—CO—(CH_2)_{20}—CH_3]_4$) (product name: WEP-5, manufactured by MITSUI CHEMICALS. INC), two parts by weight of the compound of chemical formula (2), ($C—[CH_2—O—CO—(CH_2)_{14}—CH_3]_4$) (product name: WEP-4, manufactured by MITSUI CHEMICALS. INC), is added, and toner 11 is obtained under the same conditions.

Toner 12 (Comparison Sample)

In the composition of toner 3, in the place of polypropylene with a molecular weight of 10,000 (NP105), two parts by weight of polypropylene with a molecular weight of 7,000 (product name: NP055, manufactured by Mitsui Chemical Co.) and toner 12 is obtained under the same conditions.

Toner 13 (Comparison Sample)

In the composition of toner 3, the amount of the compound of chemical formula (2), ($C—[CH_2—O—CO—(CH_2)_{20}—CH_3]_4$) (product name: WEP-5, manufactured by MITSUI CHEMICALS. INC), is changed to 0.01 parts by weight, and toner 13 is obtained under the same conditions.

Toner 14 (Comparison Sample)

In the composition of toner 3, the amount of the compound of chemical formula (2), ($C—[CH_2—O—CO—(CH_2)_{20}—CH_3]_4$) (product name: WEP-5, manufactured by MITSUI CHEMICALS. INC), is changed to 10 parts by weight, and toner 14 is obtained under the same conditions.

(3) Carrier

Carrier 1

Using a fluidized bed, a silicon resin (product name: SR2411, solid portion: 20 wt %, manufactured by Toray, Dow-Corning Silicon Co.) is coated at 2 wt % on a carrier having a 60 μm manganese ferrite particle core, then baked at 250° C. for 3 hours to obtain a resin-coated manganese ferrite carrier (carrier 1).

Carrier 2

Using a fluidized bed, an acrylic resin (product name: BR86, manufactured by Mitsubishi Rayon Co.) is coated at 2 wt % on a carrier having a 60 μm manganese ferrite particle core, then dried to obtain a acrylic resin-coated manganese ferrite carrier (carrier 2).

Carrier 3

Using a fluidized bed, a silicon resin (product name: SR2411, solid portion: 20 wt %, manufactured by Toray, Dow-Corning Silicon Co.) is coated at 2 wt % on a carrier having a 30 μm manganese ferrite particle core, then baked at 250° C. for 3 hours to obtain a resin-coated manganese ferrite carrier (carrier 3).

Carrier 4

Using a fluidized bed, a silicon resin (product name: SR2411, solid portion: 20 wt %, manufactured by Toray, Dow-Corning Silicon Co.) is coated at 2 wt % on a carrier having a 100 μm manganese ferrite particle core, then baked at 250° C. for 3 hours to obtain a resin-coated manganese ferrite carrier (carrier 4).

Carrier 5

Using a fluidized bed, a silicon resin (product name: SR2411, solid portion: 20 wt %, manufactured by Toray, Dow-Corning Silicon Co.) is coated at 2 wt % on a carrier having a 60 μm iron-powder particle core, then baked at 250° C. for 3 hours to obtain a resin-coated, iron-powder carrier (carrier 5).

(4) Evaluation Method

The following were used to measure the molecular weight of the toner.

An HLC-8120GPC (product name, manufactured by Toray) was used as the GPC apparatus; two connected TSK gel Super HM-M (product name, manufactured by Toray) columns were used for the column, and styrene and divinyl benzene gel were mainly used as the filling agent. TSK guard column Super H-H (product name, manufactured by Toray) was used as the guard column. The flow rate was 0.6 ml/min. The sample density was 0.1 wt % tetrahydrofuran, and the detector employed suggestive refraction. The calibration curve was a 3-dimensional calibration curve, and tetrahydrofuran (THF) was used as the solvent.

Printer evaluation was performed as follows:

Developer that is comprised of 95.5 wt % carrier and 4.5 wt % toner was used. AS shown in FIG. 1, a high-speed, flash-fixation type of laser printer (F6760D, manufactured by Fujitsu) was used, and it was inspected for fixation, void, filter life, odor, blurred printing, carrier adhesion, toner fluidity and developer life. The processing speed of this printer is 1200 mm/sec.

Fixation was determined to be good when the change in printing density was 10% or less when 600 g pressure is applied to the printing sample, after which mending tape (Scotch Tape) and applied peeled it off.

The void condition is checked by magnifying the printing surface with optical microscope and determined to be good when no void can be detected.

HEPA pleats and 500 g of activated carbon are used in the filter. The filter life is then checked by inspecting the pressure loss in front and behind the filter. The filter life is determined to be up at the point when the filter loss is greater than 600 $mmH_2O$. Filter life is determined to be good for 400k sheets or more.

Odor is tested by a panel of 10 people. The odor condition is determined to be excellent when 8 people or more report no odor, and it is determined to be good when 6 or more people report no odor.

Printing blur is inspected by checking for brush marks that are unique to a high-speed machine, and the condition is determined to be good when no brush marks are detected.

Carrier adhesion is checked by printing a 1-dot slash, and is determined to be good when there are only three or less void areas per 100 sheets due to carrier adhesion.

The developer life is determined to be good when there is no drop in printing density for 1000 k sheets or more.

Toner fluidity is determined to be good when it does not hinder the filling time when filling the apparatus with toner.

(5) Evaluation Results

Table 2 shows the evaluation results for the 500 or less molecular weight component and the 500 to 1000 molecular weight component of toners 1 thru 8, and a combination of toners 1 thru 8 and carrier 1.

TABLE 2

| | | Comparison sample | | Actual sample | | | | | Comparison sample |
|---|---|---|---|---|---|---|---|---|---|
| | Toner | 1 Polyester 1 | 2 Polyester 2 | 3 Polyester 3 | 4 Polyester 4 | 5 Polyester 5 | 6 Polyester 6 | 7 Polyester 7 | 8 Polyester 8 |
| Molecular weight | 500 or less | 6.5 | 2.1 | 0.8 | 1.8 | 3.5 | 2.2 | 1.1 | 11.1 |
| | 500~1000 | 11.2 | 10.1 | 8.8 | 1.2 | 6.3 | 2.3 | 0.5 | 0.5 |
| Filter | Total | 17.7 | 12.2 | 9.6 | 3.0 | 9.8 | 4.5 | 1.6 | 11.6 |
| | Filter Material | HEPA pleats | HEPA pleats | HEPA pleats | HEPA pleats | HEPA pleats | HEPA pleats | HEPA pleats | HEPA pleats |
| | Activated Carbon (g) | 500 | 500 | 500 | 500 | 500 | 500 | 500 | 500 |
| | Carrier | Carrier 1 | Carrier 1 | Carrier 1 | Carrier 1 | Carrier 1 | Carrier 1 | Carrier 1 | Carrier 1 |
| Evaluation | Fixation | ○ | ○ | ○ | ○ | ○ | ○ | ○ | ○ |
| | Anti-void | ○ | ○ | ○ | ○ | ○ | ○ | ○ | ○ |
| | Filter life (K sheets) | 100 | 250 | 450 | 750 | 550 | 650 | 1000 | 900 |
| | Filter life Pass/fail Judgement | X | X | ○ | ○ | ○ | ○ | ○ | ○ |
| | Odor | X | ○ | ◎ | ◎ | ○ | ◎ | ◎ | X |
| | Printing blur | ○ | ○ | ○ | ○ | ○ | ○ | ○ | ○ |
| | Carrier adhesion | ○ | ○ | ○ | ○ | ○ | ○ | ○ | ○ |
| | Developer life (K sheets) | 1000 or more | 1000 or more | 1000 or more | 1000 or more | 1000 or more | 1000 or more | 1000 or more | 1000 or more |
| | Developer life Pass/fail Judgement | ○ | ○ | ○ | ○ | ○ | ○ | ○ | ○ |
| | Toner fluidity | ○ | ○ | ○ | ○ | ○ | ○ | ○ | ○ |

The filter life for toner 1 and toner 2 was short, being 100K sheets and 250K sheet, respectively. The odor for toner 1 was bad. The reason for this is that the 500 to 1000 molecular weight component of toner 1 was 11.2 parts by weight, and the 500 to 1000 molecular weight component of toner 2 was 10.2 parts by weight. On the other hand, the filter life for toners 3 thru 7 was long (450K sheets or more). The 500 to 1000 molecular weight component of toner 3 was 10 parts by weight or less, and it was found that by making the 500 to 1000 molecular weight component 10 parts by weight or less it was possible to increase the life of the filter. As shown for toner 7, it was also found that the filter life was increased the closer that the 500 to 1000 molecular weight component was to 0 (0.5).

Moreover, as shown for toner 1 and 8, when the amount of the component with molecular weight of 500 or less is large, odor becomes poor. From the aspect of odor, toners 2 thru 7 were good. It can be said that odor does not occur when the value of the 500 molecular weight component of toner 1, toner 8 and toners 2 thru 7 is 4 parts by weight or less.

Polyesters No. 1 thru No. 8 were used for toners 1 thru 8 so by advancing the reaction as in the case of polyesters No. 3 thru No. 5, it is possible to reduce the monomer, dimer or trimer remaining in the polyester. It is also possible to reduce the monomer, dimer, or trimer remaining in the polyester in the case of polyesters No. 6 and No. 7 that were washed with alcohol.

Table 3 shows the results of evaluating combinations with the carrier.

TABLE 3

| | | Actual sample | Comparison | | | Actual sample |
|---|---|---|---|---|---|---|
| Toner | | Toner 9 (Polyester 3) | Toner 3 (Polyester 3) | Toner 3 (Polyester 3) | Toner 3 (Polyester 3) | Toner 3 (Polyester 3) |
| Material | Molecular weight 500 or less | 0.8 | 0.8 | 0.8 | 0.8 | 0.8 |
| | Molecular weight 500~1000 | 8.8 | 8.8 | 8.8 | 8.8 | 8.8 |
| | Total | 9.6 | 9.6 | 9.6 | 9.6 | 9.6 |
| Filter | Filter Material | HEPA pleats | HEPA pleats | HEPA pleats | HEPA pleats | HEPA pleats |
| | Activated Carbon(g) | 500 | 500 | 500 | 500 | 500 |
| | Carrier | Carrier 1 | Carrier 2 | Carrier 3 | Carrier 4 | Carrier 5 |
| Evaluation | Fixation | ○ | ○ | ○ | ○ | ○ |
| | Anti-void | ○ | ○ | ○ | ○ | ○ |
| | Filter life (K sheets) | 450 | 450 | 450 | 450 | 450 |
| | Filter life Pass/fail judgement | ○ | ○ | ○ | ○ | ○ |
| | Odor | ◎ | ◎ | ◎ | ◎ | ◎ |
| | Printing blur | ○ | ○ | ○ | X | ○ |
| | Carrier adhesion | ○ | ○ | X | ○ | ○ |
| | Developer life (K sheets) | 1000 or more | 200 | — | — | 2000 or more |
| | Developer life Pass/fail judgement | ○ | X | — | — | ○ |
| | Toner fluidity | ○ | ○ | ○ | ○ | ○ |

For toner 9 in Table 3, the colorant of toner 3 (polyester No. 3) is used in the place of magenta, which is suitable for color. In other words, for color toner as well, it is possible to increase the filter life with no odor problem.

For developers consisting of a combination of carrier 2, 3 or 4 (comparison samples), favorable results were not obtained from the aspect of developer life, carrier fixation, however for a developer that is a combination of toner 3 and carrier 5 (embodiment sample), good results were obtained in the printing evaluation. As can be seen from the results in Table 2 and Table 3, favorable printing results were obtained when the average particle diameter of the carrier was in the range 30 to 100 $\mu$m, and it was found that silicon resin was preferable as a coating.

Table 4 shows the evaluation results for showing the effects of components other than the polyester resin in the toner.

TABLE 4

| Material | Material | Comparision Sample 7 Toner 10 | Comparision Sample 8 Toner 11 | Comparision Sample 8 Toner 12 | Comparision Sample 9 Toner 13 | Comparision Sample 10 Toner 14 |
|---|---|---|---|---|---|---|
| Toner composition | PrinteX 35 (carbon) | 10 | 10 | 10 | 10 | 10 |
| | N-13 (charge controlling agent) | 1 | 1 | 1 | 1 | 1 |
| | Polyester (binder) No. 3 | 86 | 87 | 86 | 86.99 | 77 |
| | NP105 (poly-propylene) molecular weight 10000 | 2 | 2 | 0 | 2 | 2 |
| | NP055 (poly-propylene) molecular weight 7000 | 0 | 0 | 2 | 0 | 0 |
| | WEP-5 | 0 | 0 | 1 | 0.01 | 10 |
| | WEP-4 | 0 | 1 | 0 | 0 | 0 |

TABLE 4-continued

| Material | Material | Comparision Sample 7 Toner 10 | Comparision Sample 8 Toner 11 | Comparision Sample 8 Toner 12 | Comparision Sample 9 Toner 13 | Comparision Sample 10 Toner 14 |
|---|---|---|---|---|---|---|
| Molecular weight | 500 or less | 0.8 | 0.8 | 0.8 | 0.8 | 0.8 |
| | 500~1000 | 8.8 | 8.8 | 8.8 | 8.8 | 8.8 |
| | Total | 9.6 | 9.6 | 9.6 | 9.6 | 9.6 |
| Filter material | | HEPA pleats | HEPA pleats | HEPA pleats | HEPA pleats | HEPA pleats |
| Activated carbon mass(g) | | 500 | 500 | 500 | 500 | 500 |
| Carrier | | Carrier 1 | Carrier 1 | Carrier 1 | Carrier 1 | Carrier 1 |
| Fixation | | X | ○ | ○ | X | ○ |
| Anti-void | | X | ○ | ○ | X | ○ |
| Filter life | (K sheets) | 450 | 450 | 250 | 450 | 450 |
| | (Pass/fail judgement | ○ | ○ | X | ○ | ○ |
| Odor | | ◎ | ◎ | ◎ | ◎ | ◎ |
| Printing blur | | ○ | ○ | ○ | ○ | ○ |
| Carrier adhesion | | ○ | ○ | ○ | ○ | ○ |
| Developer life | (K sheets) | 1000 or more | 1000 or more | 500 | 2000 or more | 2000 or more |
| | Pass/fail judgement | ○ | ○ | X | ○ | ○ |
| Toner fluidity | | ○ | ○ | ○ | ○ | X |

Toner 10 in Table 4 is a sample in which the compound of chemical formula (5) is not added. For toner 10, filter life and odor were favorable, however, fixation and anti-void were poor. It was found that by adding the compound of chemical formula (5), it is possible to improve the printing characteristics.

As shown in the comparison sample of toner 13 and toner 14, when the range for adding this compound is less than 0.01 parts by weight, the effect for fixation and anti-void did not appear, and when it was more than 10 parts by weight, toner fluidity decreased. Therefore, the range should be between 0.01 to 10 parts by weight, and best when between 0.5 to 5 parts by weight. Moreover, as shown for toner 11, in addition to WEP5, WEP4 is also effective.

Next, as shown for toner 12 (comparison sample), when polypropylene having a molecular weight of 7,000 is added, it was found that the filter life became shorter. As shown in Table 2 and Table 3, when polypropylene having a molecular weight of 10,000 is added, there was no decrease in filter life, therefore, the molecular weight of the polypropylene added to improve the powder condition of the toner, must be 10,000 or more.

In addition to the embodiments of the described above, this invention may also be changed in the following way:

(1) In the embodiments described above, toner for flash fixation was explained, however the invention may also be applied to other fixation method when the surface temperature of the sheet is high.

(2) Non-magnetic toner for a 2-component developer was explained, however this invention may also be applied to toner for a 1-component developer (magnetic or non-magnetic) or magnetic toner for a 2-component developer.

The preferred embodiments of the present invention have been explained, however the invention is not limited to these embodiments and can be embodied in various forms within the scope of the present invention.

As explained above, this invention has the following effect:

(1) The 500 to 1,000 molecular weight component of the toner, measured by GPC, is less than 10 parts by weight of the entire toner, so it is possible to prevent clogging of the filter even when part of the toner sublimates due to fixation.

(2) With this invention it is possible to prevent the replacement period of the filter from becoming shorter during high-speed printing.

What is claimed is:

1. An image forming method comprising:

a step of forming an image on a medium by using a developer comprising a toner in which the amount of the toner measured by gel permeation chromatography to have a molecular weight of 500 to 1000 is less than 10 parts by weight with respect to 100 parts by weight of the entire toner, and wherein said toner further includes 0.01 to 10 parts for 100 parts by weight of the toner of the compound given by the following chemical formula:

$$C—[CH_2—O—CO—(CH_2)_n—CH_3]_4 \text{ where } n=14 \text{ or more;}$$

a step of performing flash fixation of the toner on said medium, and a step of collecting with a filter a sublimate of a binder resin of the toner caused by the flash fixing.

2. The image forming method of claim 1, wherein:

the amount of the toner having a molecular weight of 500 or less, measured by gel permeation chromatography, is less than 4 parts by weight with respect to 100 parts by weight of the entire toner.

3. The image forming method of claim 1, wherein:

said binder resin comprises at least a polyester resin prepared from a polyester alcohol component consisting of a bisphenol-A-alkylene oxide additive, as an alcohol, expressed by the chemical formula given below, and an acid:

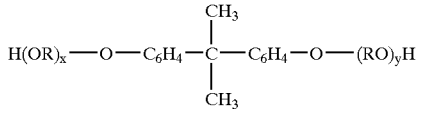

where, R is ethylene or propylene, and x and y are both integers equal to 1 or more.

4. The image forming method of claim 3, wherein:

x and y in the formula for said bisphenol-A-alkylene oxide additive are 1, and R is ethylene in up to 60 mole % of said polyester alcohol component.

5. The image forming method of claim 3, wherein said acid contains a terephthalic acid.

6. The image forming method of claim 3, wherein said alcohol component contains more than 90 mole % of said bisphenol-A-alkylene oxide additive.

7. The image forming method of claim 1, wherein:

the amount of the toner having a molecular weight of 500 or less, as measured by gel permeation chromatography, is less than 4 parts by weight with respect to 100 parts by weight of the entire toner; and said developer includes a carrier having an average particle diameter of 30 to 100 $\mu$m.

8. The image forming method of claim 1, wherein said amount of the toner measured by gel permeation chromatography to have a molecular weight of 500 to 1000 is 5 parts by weight or less with respect to 100 parts by weight of the entire toner.

9. The image forming method of claim 1, wherein the filter is a high efficiency particulate air filter.

* * * * *